US007651531B2

(12) United States Patent
Subramani et al.

(10) Patent No.: US 7,651,531 B2
(45) Date of Patent: Jan. 26, 2010

(54) BIO-TANNING PROCESS FOR LEATHER MAKING

(75) Inventors: Saravanabhavan Subramani, Chennai (IN); Thanikaivelan Palanisamy, Chennai (IN); Jonnalagadda Raghava Rao, Chennai (IN); Balachandran Unni Nair, Chennai (IN); Ramasami Thirumalachari, Chennai (IN)

(73) Assignee: Council of Scientific and Industrial Research, New Delhi (IN)

( * ) Notice: Subject to any disclaimer, the term of this patent is extended or adjusted under 35 U.S.C. 154(b) by 163 days.

(21) Appl. No.: 11/021,567

(22) Filed: Dec. 23, 2004

(65) Prior Publication Data

US 2006/0137102 A1 Jun. 29, 2006

(51) Int. Cl.
*C14C 3/08* (2006.01)

(52) U.S. Cl. ..... 8/94.33; 8/94.19 R

(58) Field of Classification Search ..... 8/94.19–94.27, 8/94.33; 426/187; 427/187
See application file for complete search history.

(56) References Cited

U.S. PATENT DOCUMENTS

| | | | | |
|---|---|---|---|---|
| 4,060,384 | A * | 11/1977 | Siegler | 8/94.27 |
| 4,310,328 | A * | 1/1982 | Monsheimer et al. | |
| 2004/0030102 | A1 * | 2/2004 | Artoni | 530/354 |

FOREIGN PATENT DOCUMENTS

| | | | |
|---|---|---|---|
| GB | 1 227 534 | * | 4/1971 |

* cited by examiner

*Primary Examiner*—Lorna M Douyon
*Assistant Examiner*—Amina Khan
(74) *Attorney, Agent, or Firm*—Ladas and Parry LLP

(57) ABSTRACT

Conventionally skins/hides are tanned with metal-ions and vegetable tannins. Environmental constraints on the discharge of toxic metal-ions and poor biodegradable vegetable tannins in the wastewater have become a serious issue. In this invention, the pelts are tanned using eco-benign bio-molecules other than vegetable tannins to reduce the pollution loads. Performance of the leathers is on par with conventionally processed leathers.

4 Claims, No Drawings

BIO-TANNING PROCESS FOR LEATHER MAKING

FIELD OF THE INVENTION

The present invention relates to a novel bio-tanning process for leather making. More particularly, the present invention provides a novel tanning process for making leathers using bio-molecules other than vegetable tannins to reduce the pollution loads. It is envisaged to have enormous potential application in leather industry for making leathers, whereby the pollution load would be significantly less compared to that of the conventional tanning process, apart from rationalizing the tanning process.

BACKGROUND OF THE INVENTION

Tanning is the process, which converts putrescible hide/skin into non-putrescible leather. Conventionally the raw or temporarily preserved hides/skins are first rehydrated well in a process called soaking and the soaked stock is subjected to liming to remove keratinous and other non-collagenous materials present in the raw hides and skins. At this stage, the hides/skins are known as pelt in the trade. The pelts are then subjected to various pre-tanning operations like deliming, bating, pickling, depending on the requirements to condition the same for the subsequent tannage. Further adjustment of pH is also required for fixing the tanning agent with collagen matrix, which is generally known as basification in the case of mineral tanning or fixing in the case of vegetable tanning.

Usually the tanning method primarily employs chromium or high molecular weight vegetable tannins for leather production. More than 90% of the leathers tanned globally contain chromium. The present commercial chrome tanning method gives rise to only about 50-70% chromium uptake as reported by Gauglhofer (Journal of the Society of Leather Technologists and Chemists, 70, 11, 1986). This poor uptake results in material wastage on one hand and ecological imbalances on the other. Buljan (World Leather, November, 65, 1996) reported that the international specification for the discharge of chromium bearing stream is less than 2 ppm. Even a high exhaust chrome tanning system does not provide such low discharge. The bio-toxicity of chromium(III) has been reported by Shrivastava and Nair (Biochemical and Biophysical Research Communications, 270, 749, 2000). Conversion of chromium(III) to chromium(VI) under oxidizing environment has been reported by Fathima et al (Journal of the American Leather Chemists Association, 96, 444, 2001). The disposal of chrome containing solid wastes and sludges is posing a major challenge as reported by Germann (Science and Technology for Leather into the Next Millennium, Tata McGraw-Hill Publishing Company Ltd., New Delhi, p. 283, 1999). Chromium(III) salt finds extensive usage in leather processing but the environmental concerns due to chromium pollution has led to the search for alternative tanning agents. Vegetable tanning, a natural material, has been considered as a suitable eco-friendly option to replace chromium and it is being employed for making some kinds of leathers. However, vegetable tanning leads to excessive loading in the leathers, which reduces its versatility to make different end products and also has low resource availability. Vegetable tannins are also known to be poorly biodegradable, which results in high biochemical oxygen demand (BOD) and chemical oxygen demand (COD).

Mineral tanning agents such as aluminium, titanium, iron, zirconium have been explored for their solo tanning potential for replacing chromium. However, each one has inherent disadvantages associated with them as highlighted by Madhan et al (Journal of the American Leather Chemists Association, 97, 189, 2002). Though aluminium and titanium tanning produces white leathers, the characteristics of the leathers are poor, especially hydrothermal stability. Iron tanned leathers undergo darkening of colour during ageing and also have poor strength characteristics. Zirconium tanning is known to produce leathers with drawn grain. Hence, the combination tannages were considered as suitable method to overcome the problems from single tanning system. Various combination-tanning systems exist in the world. Presently, the combination systems mainly based on less chrome and chrome free. Examples for less chrome combination tanning system are chromium and silica, chromium and iron, etc. Chrome free combination systems based on vegetable and metal ions other than chromium have been explored by Kallenberger and Hernandez (Journal of the American Leather Chemists Association, 78, 217, 1983). However, all these combination systems do not have commercial importance in the global leather industry due to processing difficulty, toxicity, availability, cost, etc.

The use of protein hydroylsates in leather processing as filling agent during post tanning has been reported by Chen et al (Journal of the American Leather Chemists Association, 96, 262, 2001) and as chrome exhaust aid by Ramamurthy et al (Journal of the Society of Leather Technologists and Chemists, 73, 168, 1989). Traubel et al (U.S. Pat. No. 6,254,644, 2001), manufactured biodegradable leather by tanning delimed pelt with aldehydes or bisulphite-blocked polyisocyanate. The use of an enzyme, transglutaminase, for tanning skins/hides, termed as enzymatic tanning, has been reported by Feigel et al (United States Patent Application 20020155524, 2002), whereby the hides are preferably treated with 0.5-10% transglutaminases and preferably aqueous solution at a pH between preferably 5 and 9 and at a temperature between 20 and 40° C. The major limitations associated with this process are high cost and its inability to produce variety of leathers as reported by Collighan et al (Journal of the American Leather Chemists Association, 99, 289, 2004). No prior art is available for tanning hides/skins with collagen based tanning agent or other related biological compounds.

OBJECTS OF THE INVENTION

The main objective of the present invention is to provide a novel bio-tanning process for leather making, which precludes the drawbacks stated above.

Another objective of the present invention is to provide a bio-tanning process that does not require pickling and basification steps.

Yet another objective of the present invention is to provide a bio-tanning process that does not employ any chemicals or additives for tanning.

Still another objective of the present invention is to provide a bio-tanning process that provides soft and smooth leathers.

Yet another objective of the present invention is to provide a bio-tanning process that provides leathers matching properties of leathers from conventional leather processing steps.

Still another objective of the present invention is to provide a bio-tanning process to make biodegradable leather.

Yet another objective of the present invention is to provide a bio-tanning process that leads to significant reduction in pollution loads and non-toxic chemicals.

SUMMARY OF THE INVENTION

Accordingly, the present invention provides a bio-tanning process for leather making, which comprises treating a pelt in aqueous medium with a collagen based tanning agent to obtain bio-tanned leather.

In one embodiment of the invention, the collagen based tanning agent used may be selected from collagen hydrolysate, collagen polypeptide.

In another embodiment of the present invention, the amount of water used for tanning may be in the range of 50-150% by volume on the weight of the pelt.

In another embodiment of the invention the collagen based tanning agent is used in an amount of 5-15% w/w.

In yet another embodiment of the invention, the pelt is treated at a pH range of 7.0 to 8.5.

In another embodiment of the invention, the pelt is treated under dynamic condition.

In another embodiment of the invention, the pelt is treated at a temperature not exceeding 45° C. and for a period of not less than 2 hours.

The present invention also provides a bio-tanning process for leather making, which comprises treating a pelt in aqueous medium with 5-15% w/w, of collagen based tanning agent in the pH range of 7.0 to 8.5, preferably under dynamic condition, at a temperature not exceeding 45° C. for a period of not less than 2 hours to obtain bio-tanned leather.

DESCRIPTION OF THE INVENTION

The process of the present invention is described below in detail.

Pelts are treated with 5-15% w/w, of collagen based tanning agent in a medium containing 50-150% by volume of water on the weight of the pelt preferably under stirring condition at a pH in the range of 7.0 to 8.5 for a period of not less than 2 hours at a temperature not exceeding 45° C. to get bio-tanned leather.

The inventive step of the present invention lies in treating the pelts with collagen based tanning agent at a pH 7.0-8.5 to obtain tanned leathers, without using any other chemicals thereby providing an eco-friendly tanning method.

The invention is described in detail in the following illustrative examples, which should not be construed to limit the scope of the present invention.

Example 1

Five bated goatskin pelts having fleshed pelt weight of 4 kg were taken in a small experimental tanning drum. Cross section pH of the bated pelts was found to be 8.0. 200 gms collagen hydrolysate along with 4000 ml water was added simultaneously to the drum. Drum was run for 3 hrs at 40° C. After stopping the drum, the cross section pH of the tanned leathers was found to be 7.5. The hydrothermal stability of the tanned leathers was found to be increased by 10° C. to that of bated pelts (hydrothermal stability of bated pelt was 58° C.). The resulting bio-tanned leathers were taken out from the drum and piled.

Example 2

Five bated sheepskin pelts having fleshed pelt weight of 5 kg were taken in a small experimental tanning drum. Cross section pH of the bated pelts was found to be 7.0. 250 gms collagen hydrolysate along with 2500 ml water was added simultaneously to the drum. Drum was run for 2 hrs at 35° C. After stopping the drum, the cross section pH of the tanned leathers was 7.0. The hydrothermal stability of the tanned leathers was found to be increased by 11° C. to that of bated pelts (hydrothermal stability of bated pelt was 57° C.). The resulting bio-tanned leathers were taken out from the drum and piled.

Example 3

Four bated buff calf pelts having fleshed pelt weight of 12 kg were taken in a tanning drum. Cross section pH of the bated pelts was found to be 8.0. 1200 gms collagen polypeptide along with 18 lit water was added simultaneously to the drum. Drum was run for 6 hrs at 45° C. After stopping the drum, the cross section pH of the tanned leathers was 7.2. The hydrothermal stability of the tanned leathers was found to be increased by 11° C. to that of bated pelts (hydrothermal stability of bated pelt was 59° C.). The resulting bio-tanned leathers were taken out from the drum and piled.

Example 4

Two cow delimed pelts having fleshed pelt weight of 13 kg were taken in a tanning drum. Cross section pH of the bated pelts was found to be 8.0. 1950 gms collagen hydrolysate along with 13 lit water was added simultaneously to the drum. Drum was run for 10 hrs at 38° C. After stopping the drum, the cross section pH of the tanned leathers was 8.0. The hydrothermal stability of the tanned leathers was found to be increased by 10° C. to that of bated pelts (hydrothermal stability of bated pelt was 59° C.). The resulting bio-tanned leathers were taken out from the drum and piled.

Example 5

Two buff delimed pelts having fleshed pelt weight of 18 kg were taken in a tanning drum. Cross section pH of the bated pelts was found to be 8.0. 2700 gms collagen hydrolysate along with 13 lit water was added simultaneously to the drum. Drum was run for 10 hrs at 34° C. After stopping the drum, the cross section pH of the tanned leathers was 7.5. The hydrothermal stability of the tanned leathers was found to be increased by 9° C. to that of bated pelts (hydrothermal stability of bated pelt was 58° C.). The resulting bio-tanned leathers were taken out from the drum and piled.

The Following are the Advantages of the Present Invention:

1. This process is able to shift the leather processing from chemical to bio-based thereby providing environmental friendly tanning method and presents no disposal problems.

2. This process hardly requires any complicated control measures.

3. This process does not require pickling, basification steps during tanning. In other words, no significant changes in pH are required.

4. Provides significant reduction in total solids and chemical oxygen demand.

5. The process leads to considerable reduction in time, power and water.

6. It completely eliminates the formation of dry sludge such as chromium-based sludges.

7. Provides rationalization of tanning processes.

8. Suitable for all kinds of raw materials.

9. The process produces soft and supple leathers.

10. Easy to handle after tanning.

We claim:

1. A bio-tanning process for leather making, which comprises treating a pelt in a solution consisting of an aqueous medium with 5-15% w/w of a collagen based tanning agent without adding a chromium compound in the pH range of 7.0 to 8.5, at a temperature not exceeding 45° C. for a period of not less than 2 hours to obtain bio-tanned leather.

2. A process as claimed in claim 1 wherein the collagen based tanning agent is selected from the group consisting of collagen hydrolysate and collagen polypeptide.

3. A process as claimed in claim 1 wherein the aqueous medium is prepared using water in an amount of 50-150% by volume of the weight of the pelt.

4. A process as claimed in claim 1 wherein the treating is carried out in a tanning drum.

* * * * *